United States Patent [19]

Goff et al.

[11] 4,234,176

[45] Nov. 18, 1980

[54] QUICK RELEASE CLAMP

[76] Inventors: Otis W. Goff, 5221 Woodmont Dr., Kalamazoo, Mich. 49001; Melvin J. Goff, 2454 52nd, SW, Wyoming, Mich. 49509

[21] Appl. No.: 67,621

[22] Filed: Aug. 17, 1979

[51] Int. Cl.[3] ..... B25B 1/10

[52] U.S. Cl. ..... 269/156; 269/249

[58] Field of Search ..... 269/156, 249, 239

[56] References Cited

U.S. PATENT DOCUMENTS

| | | | |
|---|---|---|---|
| 2,133,892 | 10/1938 | Gelinski | 269/249 |
| 2,576,904 | 11/1951 | Jessen et al. | 269/249 |
| 2,610,661 | 9/1952 | Romine | 269/249 |
| 2,642,905 | 6/1953 | Hewat | 269/249 |
| 3,934,316 | 1/1976 | Driscoll | 269/249 |

FOREIGN PATENT DOCUMENTS

| | | | |
|---|---|---|---|
| 807799 | 4/1951 | Fed. Rep. of Germany | 269/156 |

*Primary Examiner*—Robert C. Watson

*Attorney, Agent, or Firm*—Gordon W. Hueschen

[57] ABSTRACT

A quick release clamp which comprises a U-shaped frame formed by two stampings spaced apart and held together in a unitary structure by means of spacers and rivets. In one arm of the frame, a screw block is anchored in which an elongated screw member is threaded and has on its inner end a clamping face. In the opposite arm a similar elongated threaded member is threaded through a block and has on its end a clamping face which is apposed to the first clamping face. In this latter case the block into which the elongated screw member is threaded is pivoted in the frame so that the clamping face can be swung away from alignment with the other clamping face.

7 Claims, 4 Drawing Figures

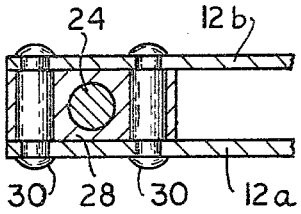
FIG. 4
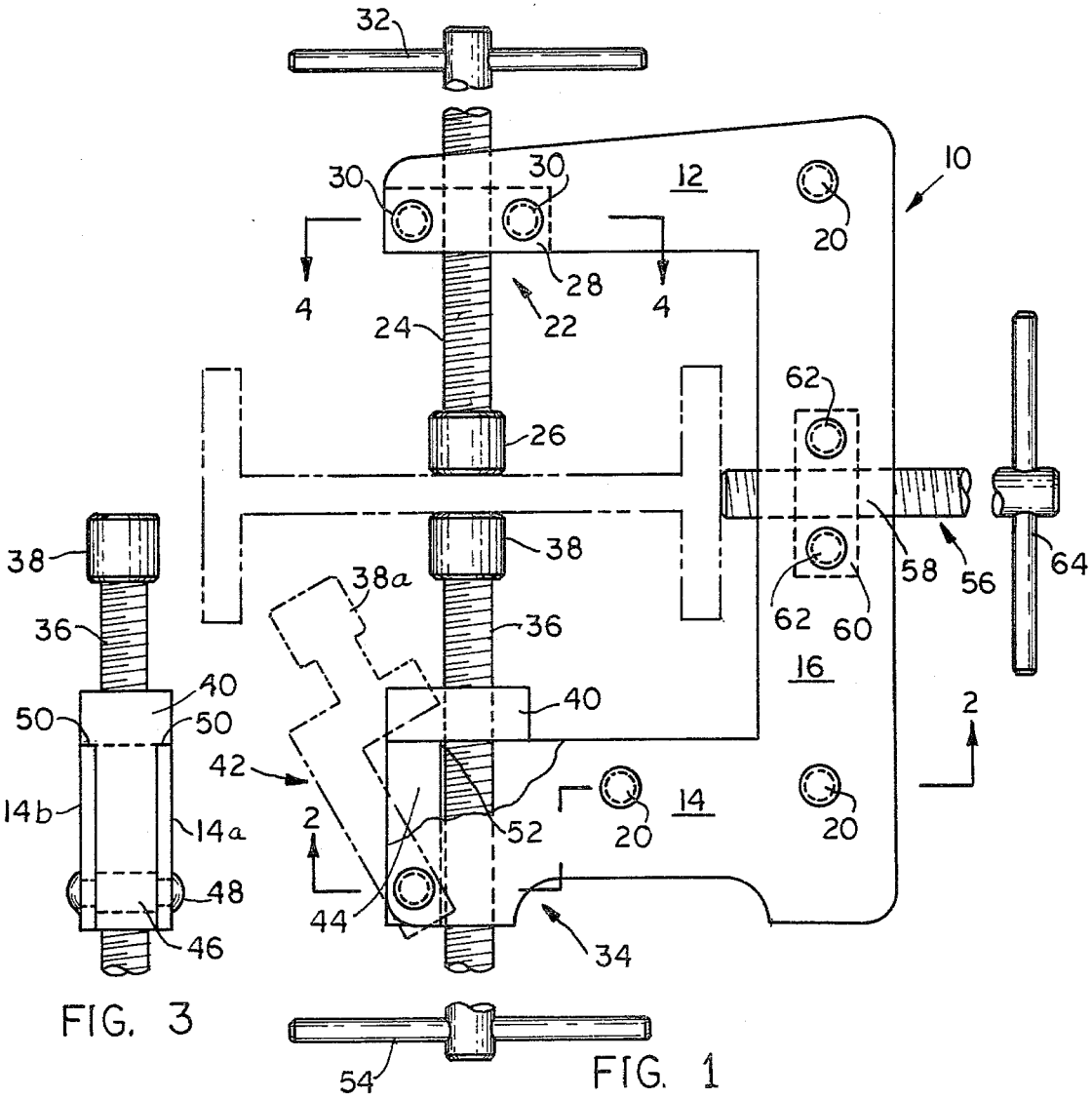
FIG. 3
FIG. 1
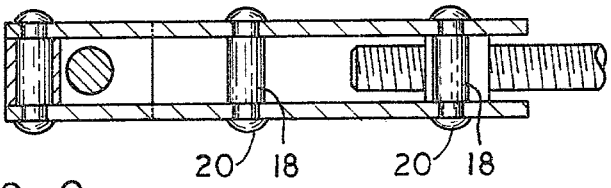
FIG. 2

QUICK RELEASE CLAMP

FIELD OF INVENTION AND PRIOR ART

This invention relates to a quick release clamp.

U-clamps are commonly used in connection with intricate shapes, such as I-beams or H-beams where it is desired to clamp material to a part of the work piece which is relatively inaccessible, for example, the web of an I-beam or an H-beam. Such clamps ordinarily comprise a U-shaped frame with an elongated member threaded in the legs thereof on a common axis and having clamping faces at the inner ends thereof apposed one to the other in clamping position to hold a work piece between them. Such clamps have the difficulty that one or both of the elongated members must be screwed out a considerable distance before the clamp can be removed from the work piece. C-clamps and the like also have the disadvantage that the clamping screw must be sometimes unscrewed a considerable distance to effect release of the clamped object.

OBJECTS OF THE INVENTION

It is an object of the invention to provide an improved quick release clamp. It is a further object of the invention to provide such a clamp which can readily be removed from the work piece with a minimum amount of retracting of the elongated screw members. It is a further object of the invention to avoid the disadvantages of the prior art and to obtain such advantages as will appear as the description proceeds.

BRIEF DESCRIPTION OF THE INVENTION

The invention relates to a quick release clamp which comprises a base member having an upstanding arm unitary therewith; a clamping face associated with said upstanding arm; screw actuated clamping means projecting through the upstanding arm to the clamping face; holding means for holding a work piece in position apposed to the clamping face; the clamping means in the clamping position being aligned in a center line essentially normal to the upstanding arm and being operative to move the clamping face toward clamping position and to apply pressure to the work piece; and quick release means associated with the clamping means operative to move the clamping face from its normal position to a position in which it is no longer apposed to the work piece and the clamping means is no longer aligned with the work piece.

Advantageously, the quick release means comprises a pivoted block in which the screw actuated clamping means is threaded, whereby when said block is rotated about its pivot the clamping means and the clamping face thereon will be swung out of alignment with the work piece.

Advantageously, the pivoted block is L-shaped, the screw actuated clamping means is threaded into the short leg of the L, the long leg of the L is pivoted adjacent its end, and in the aligned position the short leg abuts the inner side of the arm to which said block is pivoted so that the pressure engendered by tightening the clamping means is transferred through the short leg to the arm on which it abuts. The bight of the L is so positioned relative to the bottom of the arm to which the block is pivoted, that on rotation of the block by its pivot, the short leg is rotated out of abutment with the inner face of the leg.

If desired, the means for holding a work piece can be a second upstanding arm on said base member parallel to the first arm and having a second clamping face associated therewith which is apposed to the first clamping face. The second clamping face can be affixed to the second arm or be a part thereof, or be at the end of a second screw actuated clamping means aligned in the same transverse center line as the first clamping means. The second clamping means can be threaded directly into the second arm or into a block affixed thereto, or into a pivoted block as with the first clamping means.

Advantageously, the end of the upstanding arm is bifurcated to form a yoke and the long leg of the block is pivoted in this yoke. The yoke may be machined in a casting or built up by constructing the arm of elongated, thin, narrow, parallel plates. The short leg of the pivoted block extends laterally from each side of the long leg a distance substantially equal to the thickness of the sides of the yoke, thereby forming shoulders that abut the inner faces of the yoke.

Advantageously, both arms comprise this, narrow, parallel plates of essentially the same configuration and the second screw actuated clamping means is threaded into the block anchored between the narrow plates of the second arm. Advantageously, also, the base member comprises two thin, narrow, parallel plates integral with the other-named narrow plates. The parallel plates are riveted, or otherwise united, into a unitary structure and the pivoted block is frictionally engaged to prevent free rotation about its pivot.

If desired, a positioning screw means can be threaded in a block anchored between the narrow plates of the base member intermediate the two arms thereof and so oriented that its center line is normal to the transverse center line through clamping means and the apposed clamping faces.

If desired, also, the first clamping face may be at the end of a second screw actuated clamping means aligned in said transverse center line.

BRIEF DESCRIPTION OF THE DRAWINGS

FIG. 1 is a side elevation.

FIG. 2 is a cross-section taken along lines 2—2 of FIG. 1.

FIG. 3 is a partial bottom view of FIG. 2.

FIG. 4 is a partial section taken along lines 4—4 of FIG. 1.

DETAILED DESCRIPTION OF THE INVENTION

The quick release clamp, according to the invention, comprises a U-shaped frame 10 having parallel arms 12 and 14 projecting unitarily from a base member 16.

The arms 12 and 14 and base member 16 are stamped from a relatively thick sheet of steel. Two such stampings form the U-shaped frame 10 and are spaced apart by spacers 18 and held together in unitary structure by the rivets 20.

Fastened at the bottom end of arm 12 is a clamping means 22 comprising an elongated screw 24 having a clamping face 26 at the end thereof. A screw 24 is threaded in a block 28 which is anchored in the arm 12 by rivets 30. A handle 32 is provided on the outer end of the screw 24, on turning of which, the clamping face 26 is advanced inwardly or retracted outwardly.

A second clamping means 34 is provided at the end of arm 14. It comprises an elongated screw 36 having a clamping face 38 at the end thereof. It is threaded in a block 40 which abuts the inner surface of the arm 14. The two screws 24 and 36 are aligned on a common centerline so that the clamping faces 26 and 38 can be moved to and from a position where they clamp a work piece between them.

The block 40 is the short leg of an L-shaped block 42, the long leg 44 of which is journaled on a pivot pin 46 which is anchored in the arm 14 by rivet 48. The head of the block 42, that is the short leg 40, extends beyond the side plates 14*a* and 14*b* of the arm 14 to provide shoulders 50 which abuts the inner faces of the sides 14*a* and 14*b*. The bight 52 of the L-shaped block 42 is so positioned with reference to the faces of the arm members 14*a* and 14*b* against which it abuts that it can swing down out of frictional engagement in arm 14 to the position shown in dotted lines.

The elongated screw 36 is provided with a handle 54 corresponding to the handle 32 and serving the same purpose.

If desired, there may be provided in the base member 16 a positioning screw means 56 comprising an elongated threaded member 58 threaded in block 60 which is anchored in the base member 16 by rivets 62. The positioning screw also has a handle 64 for adjusting the position of the elongate member 58. Elongate member 58 is positioned on a line or an axis which is normal to the centerline of the elongated threaded members 24 and 36.

In the operation of the device the clamping faces 26 and 38 are adjusted near the center of the clamp at a spacing sufficient to receive the web of the I-beam shown in dotted lines. The L-shaped block 42 is then swung down to a position shown in dotted lines or farther down, if desired, and the clamp hooked over the I-beam. If the space between the clamping face 26 and the clamping face 38*a* is not sufficient to admit the beam, the L-shaped block can be rotated farther down or the clamping face 38 can be retracted until the I-beam can get through the space between the clamping face 26 and the clamping face 38*a*. When the I-beam is in position shown in the dotted lines, the L-shaped block 42 is swung back to the initial operative position and the handle 54 is turned to advance the clamping face 38 against the web of the I-beam. It will be understood, of course, that the clamping face 26 can be advanced or retracted as desired to position the web in the desired position. The block 42 may be frictionally engaged between the plates 14*a* and 14*b* so that it will stay in any position to which it is rotated.

It is to be understood that the invention is not to be limited to the exact details of operation or structure shown and described, as obvious modifications and equivalents will be apparent to one skilled in the art. Thus, the screw 24 can be eliminated and the clamping face 26 affixed to or made integral with the arm 12. Also, the arm 12 can be eliminated and other means used to position the clamping face 38 opposite a work piece. The base 16, for example, can be provided with means for rigidly attaching it to the bed of a machine tool so that the clamping face 38*a* can quickly be swung into a position in which it is apposed to a work piece on the bed of the tool. Also, the quick release feature can be provided in place of the fixed block 22.

We claim:

1. A quick release clamp comprising a base member having an upstanding arm unitary therewith, a clamping face associated with said arm, screw actuated, clamping means projecting from said upstanding arm to said clamping face, holding means for holding a work piece in a position apposed to said clamping face, said clamping means, in the clamping position, being aligned in a centerline essentially normal to said arm and being operative to move said clamping face toward clamping position and to apply pressure to a said work piece, and quick release means associated with said clamping means operative to move said clamping face from its normal position to a position in which it is no longer apposed to the work piece and said clamping means is no longer aligned with said work piece, in which said quick release means comprises a pivoted block into which said screw actuated clamping means is threaded, whereby, when said block is rotated about its pivot, said clamping means and said clamping face will be swung out of alignment with the work piece, and in which said pivoted block is L-shaped, in which said screw actuated clamping means is threaded into the short leg of the L, in which the long leg is pivoted adjacent its end, and in which in the aligned position, the short leg abuts the inner side of said arm, whereby the pressure engendered by tightening up said clamping means is transferred through said short leg to the arm on which it abuts, and the bight of said L is so positioned relative to the bottom of the arm to which the block is pivoted, that on rotation of the block about its pivot, the short leg is rotated out of abutment with the inner face of said arm.

2. A quick release clamp, according to claim 1, in which said arm terminates in a yoke having narrow, parallel sides, in which the long leg of said pivoted block has a width such that it fits in between said parallel sides and is pivoted on a pivot pin anchored therein, and in which the short leg of said pivoted block is wider than the long leg and extends on each side a distance substantially equal to the thickness of the sides of said yoke, thereby forming shoulders that abut the inner faces of the sides of said yoke.

3. A quick release clamp, according to claim 2, in which said arm comprises elongated thin, narrow paralled plates which at the end of said arm form the sides of said yoke.

4. A quick release clamp, according to claim 3, which further comprises a second upstanding arm unitary with said base and parallel to the first arm, and in which the second said arm comprises thin, narrow parallel plates of essentially the same length as the first-named narrow plates and which further comprises a second screw actuated clamping means is threaded into a block anchored between said narrow plates and a second clamping face on the inner end thereof apposed to the first, the two said clamping means being aligned in a common centerline.

5. A quick release clamp, according to claim 4, in which the said base member comprises two thin, narrow plates integral with the above-named narrow plates.

6. A quick release clamp, according to claim 5, in which a positioning screw means is threaded in a block anchored between the narrow plates of said base member intermediate the two arms thereof and oriented so that its centerline is normal to the centerline of the apposed clamping means.

7. A quick release clamp, according to claim 2, in which the long leg of said block is frictionally engaged by the sides of said yoke so that when it is rotated on its pivot it will stay in any position to which it is rotated.

* * * * *

UNITED STATES PATENT AND TRADEMARK OFFICE

CERTIFICATE OF CORRECTION

PATENT NO. : 4,234,176

DATED : November 18, 1980

INVENTOR(S) : Otis W. Goff and Melvin J. Goff

It is certified that error appears in the above—identified patent and that said Letters Patent is hereby corrected as shown below:

Col. 2, line 22; "this," should read -- thin, --

Signed and Sealed this

*Twenty-sixth* Day of *May 1981*

[SEAL]

*Attest:*

RENE D. TEGTMEYER

*Attesting Officer*

*Acting Commissioner of Patents and Trademarks*